US005269035A

United States Patent [19]

Hartunian

[11] Patent Number: 5,269,035

[45] Date of Patent: Dec. 14, 1993

[54] HEAD SUPPORT FOR PERSON LYING IN PRONE POSITION

[76] Inventor: Byron V. Hartunian, 777 Concord Ave., Cambridge, Mass. 02138

[21] Appl. No.: 984,953

[22] Filed: Dec. 3, 1992

Related U.S. Application Data

[63] Continuation-in-part of Ser. No. 890,315, May 26, 1992, abandoned, which is a continuation-in-part of Ser. No. 838,855, Mar. 16, 1992, abandoned.

[51] Int. Cl.[5] ..... A47G 9/00

[52] U.S. Cl. ..... 5/638; 5/637; 5/639

[58] Field of Search ..... 5/638, 636, 637, 639; D6/601

[56] References Cited

U.S. PATENT DOCUMENTS 2,688,142 9/1954 Jensen ..... 5/644

*Primary Examiner*—Alexander Grosz
*Attorney, Agent, or Firm*—Herbert L. Gatewood

[57] ABSTRACT

A head support means is provided for supporting a person's head while lying in the prone position. The support means provides support of the patient's head at the chin and forehead. A side opening provides means for an anesthetist to view a patient's face and for passage of endotracheal or other tubes and various probes that might be used during surgery.

16 Claims, 3 Drawing Sheets

HEAD SUPPORT FOR PERSON LYING IN PRONE POSITION

CROSS-REFERENCE TO RELATED APPLICATIONS

This application is a continuation-in-part of Application Ser. No. 07/890,315, filed May 26, 1992, now abandoned entitled Stomach Sleeper Pillow which, in turn, is a continuation-in-part application of Application Ser. No. 07/838,855, entitled Stomach Sleeper Pillow, filed Mar. 16, 1992, both now abandoned.

BACKGROUND OF THE INVENTION (1). Field of the Invention

This invention relates, in general, to pillows and cushions or head supports and, more particularly to a compressible means for supporting one's head and neck during an operation. Even more specifically, the invention relates to an orthopedic support means whereby a patient's forehead and chin may be supported when the patient is lying in a prone position, i.e., face down on the stomach.

(2). Description of the Prior Art

There are three basic reclining positions, namely, prone, supine, and hemiside. when lying down, e.g. to go to sleep, a person may choose to lie in one position or the other. Actually, while sleeping, however, a person may sometimes intentionally, or other times unconsciously, change from one position to the other.

Many persons prefer, when going to sleep, to lie in the prone position, i.e., face down on their stomach. A major problem with lying in such a position, however, is that in order to breathe properly the neck must be turned at an acute angle of almost 90 degrees. This somewhat awkward positioning of the neck invariably causes increased pressure on the structures that support and comprise the neck anatomy. These include the discs, the joints, the ligaments and the muscles of the neck. Also, as a result of the neck being so turned, the cervical nerves can be irritated causing pain.

Thus, it is not uncommon for persons that sleep in the prone position to have cervical muscle sprain, ligament sprain and cervical nerve injury as a result of symptoms related to lying in that position with the neck rotated acutely. In some cases, at least, the problems can become quite severe, necessitating orthopedic surgery.

In certain surgery also, it is necessary for the patient to lie on the operating table in the prone position. There is no choice. This may even be for operation on, e.g., a herniated cervical disc. And such may have resulted from that patient having slept in the prone position and unduly twisting his neck as earlier disclosed. Obviously, such a patient cannot have his neck twisted for performing such an operation. The patient's head in such an operation must be supported in an upright position in a suitable manner. This necessitates, however, whatever the manner of support, that the patient be made comfortable and, of critical concern, that his breathing be unobstructed. It is also important that such a patient's head be supported during the operation in such a manner that his spine is maintained in a linear anatomic position.

Of further, and critical, importance also is the fact that during an operation wherein the patient is lying in the prone position, it is necessary that the anesthetist or anesthesiologist be able to view the patient's face and facial features during the administration of anesthetics.

Furthermore, there is need for there to be provided one or more openings in the head support for use by the anesthetist, for endotracheal air tubes, nasogastric tubes, etc., commonly used during surgical operations.

Heretofore, others have been somewhat active in making inventions suitable for use in the support of a patient's head in various types of surgical operating procedures. Exemplary of such prior art head supports of which I am aware are those disclosed in U.S. Pat. Nos. 3,694,831; 4,074,376; 4,710,991; 4,752,064; and 4,757,983.

U.S. Pat. No. 3,694,831, which issued on Oct. 3, 1972, discloses a so-called "medical head support" which, in general, comprises a body including a base portion and an upper portion, each of a porous, open cell polyurethane foam. The base portion is of a cubic shape with a hole extending vertically downwardly therein from the top to the bottom surface. The upper portion comprises two spaced-apart pads each having a top planar-surface which slopes inwardly and downwardly. Thus, there is provided an elongated groove. This groove is provided with opposed arcuate-shaped notches at a location above the top opening of the hole in the base member. The patient's head is thus supported by the spaced-apart pads, the groove and arcuate notches providing an open space into which the patient's nose and face may intrude. According to the patentee there is no danger of the patient's breathing becoming blocked since the coarse foam of the base portion will allow free flow of air through the base portion into the cylindrical-shaped opening provided in the base. Furthermore, it is disclosed that a free flow of air is allowed into the groove from the coarse foam of the pads.

The medical head support disclosed in U.S. Pat. No. 3,694,831 is, to my knowledge, the only such device as disclosed in the above mentioned patents presently being used for its intended purposes. Nevertheless, the use of this head support is attendant with certain disadvantages. It does not offer full support to a patient's forehead. And, it offers no support at all to a patient's chin. Thus, as a result, the patient's cheek bones are primarily the means by which a patient's head is supported by the head support disclosed. This results in pressure points at the cheek bones which during a long operation can result in extreme soreness. Moreover, the manufacture of the head support disclosed in U.S. Pat. No. 3,694,831 is bound to be somewhat costly. This is due, at least in part, to the fact that a number of separate components are formed separately and then assembled together.

The invention disclosed in U.S. Pat. No. 4,074,376 is a contoured security pillow which, according to the patentee, is for supporting a person's head in the hemiside reclining position. Although this pillow may be found quite satisfactory for its intended purpose, such would not be suitable at all because of its structure for supporting a patient's head in the prone position.

U.S. Pat. No. 4,710,991 discloses a headrest pillow for use in combination with the headrest provided on a conventional therapeutic table. Such a table, as disclosed in U.S. Pat. No. 4,710,991, comprises two spaced-apart elongated support pads typically being made of felt, foam rubber or polyurethane foam and covered by an outer covering of leather or suitable synthetic plastic material. The spaced-apart pads define an elongated trough or groove into which a person's nose and mouth intrude when such a patient is in the prone position. According to the patentees, the pads in supporting a patient's head have been found not to distribute the weight evenly and, accordingly, not only discomfort but pressure necrosis may result.

Thus, the invention in 4,710,991 provides a pillow for use in combination with a headrest such as is disclosed. The headrest pillow comprises a plurality of layers of plastic film sealed together in such a manner that individual chambers are provided for inclusion of a suitable viscous gel. Such a pillow is suitably fastened to each of the head support pads allowing for more even, according to the patentees, distribution of support and weight forces between the headrest and patient's head thereby making the conventional headrest more comfortable to the user.

Although such a headrest pillow as disclosed in U.S. Pat. No. 4,710,991 may be found quite suitable for use as disclosed, it does not appear that such a pillow could be used at all without other support means, e.g. the headrest disclosed in U.S. Pat. No. 4,710,991, in combination therewith, in an operation wherein the patient is in the prone position. It seems also that although the headrest pillow may better distribute the weight of the patient's head, as claimed by the patentees, the same problem to be solved still exists. The patient's head is still supported by the cheekbones.

Furthermore, the manufacture of the headrest pillow in U.S. Pat. No. 4,710,991 is believed likely to be somewhat costly. It involves not only the lamination of a plurality of plastic films together, during which a plurality of individual chambers are formed, but also the inclusion of a viscous gel in each such a chamber. Moreover, it seems likely that one or more of the gel filled pockets may tend to leak, through repeated handling of the headrest pillow. This is particularly a possibility, if such pillows are capable of being sterilized again and again for repeated usage.

U.S. Pat. No. 4,752,064 discloses a therapeutic head support of resilient closed cell medical foam, according to the patentee, for supporting a patient's head face down during an operation. The device is comprised of a cubic-shaped pillow having a T-shaped void provided therein which extends from the top surface through to the bottom surface. This T-shaped void, according to the patentee, conforms to the contours of a patient's face. According to the disclosure in U.S. Pat. No. 4,752,064, the shape of the void provides total support for the head but does not interfere with the critical facial areas of the mouth, nose, and eyes.

Nevertheless, it is believed that a critical disadvantage results in the use of such a head support, as disclosed in U.S. Pat. No. 4,752,064. This resides in the fact that in order for the surgeon to be able to communicate with the patient during an operation a special support system for the pillow must be used. Thus, the pillow is located off the operating table, supported by a horizontally disposed plate having a corresponding T-shaped opening provided therein. An adjustable mirror is located below the plate so that the patient's face can be seen by the physician and communication can be maintained, if desired. The requirement for such a support system with the invention disclosed is deemed, moreover, a necessity for a surgical operation on a patient in the prone position. otherwise, there is no way in which the patient's face can be observed by the anesthetist. As can be readily appreciated, the cost for such a therapeutic head support as disclosed in U.S. Pat. No. 4,752,064, at least initially, will be increased considerably due to the necessity of having to also purchase a support system, even though it can be used repeatedly later with any number of the same construction therapeutic head supports.

U.S. Pat. No. 4,757,983 discloses a head and chin rest for face-down operations. The head and chin rest comprises, in general, a frame including spaced-apart cushioned forehead and chin supports. The chin and forehead supports can be on the same level or one above the other, as desired. Although, the various prototypes of the invention disclosed in U.S. Pat. No. 4,757,983 may provide good results in use in that each allows ready and convenient access to the prone patient's face, in particular the nose and mouth, by the anesthesiologist, the fact remains that such supports are relatively complex in structure. Furthermore, it is believed that such head and chin rests are likely to be somewhat costly to manufacture.

Thus, there still remains a need for a means of relatively simple construction to properly support a person's head when lying in the prone position during a surgical operation. Such a means need allow freedom for unobstructed breathing and easy access to the person's nose and mouth by an anesthetist. Moreover, such a head rest need be capable of being economically manufactured.

SUMMARY OF THE INVENTION

Accordingly, it is a general object of this invention to overcome the disadvantages of head rests known from the prior art.

More particularly, it is an object of the present invention to provide an improved support means for supporting one's head while lying in the prone position which is not possessed of the aforementioned problems and disadvantages.

It is a major object of the invention to provide means for supporting a patient's head while lying in the prone position wherein the patient's chin and forehead are supported.

It is a further object of the invention to provide means for supporting a patient's head while lying in the prone position and maintaining that person's spine in a linear anatomic position.

Another object of the invention is to provide means for supporting a patient's head in the prone position wherein the head is not supported by the cheekbones.

A further object is to provide a support means for a patient's head while lying in the prone position that is comfortable to the patient.

An additional object is to provide means for supporting a prone patient's head during surgery that is of simple construction.

A concomitant object is to provide a means for supporting and immobilizing a prone patient's head during a surgical procedure that is deemed economical in cost relative to known such devices due to its relative ease in manufacture.

Still another object of the invention is to provide means for supporting a patient's head while lying in the prone position during an operation yet providing clear unobstructed air passageways on each side of the head in the cheek areas.

A further object of the invention is to provide a support for a patient's head while lying in the prone position but one allowing clear observation of the patient's face and easy and convenient access by the anesthesiologists to all tubes exiting the nose and mouth of the patient.

Quite advantageously, the unique shape,,of the head support means of this invention substantially maintains a linear anatomic position of the spine thereby preventing irritation of nerves, ligaments, muscles and discs in one's neck. Furthermore, it allows air to circulate around the face and protects the eyes and nose especially important during surgery on the spine, when a person need be in the prone position. The invention's construction is such, moreover, that the cheekbones of the patient's face are not in contact with the support means. Thus, no pressure points are provided at these areas of the patient's face, avoiding possible soreness thereto.

Another advantage of the invention is that the head support's unique shape and construction in one embodiment of the invention allows safe positioning of the endotrached tube used in general anasthesia by the anesthesiologist, and access thereto. This more preferred embodiment of the invention, moreover, allows ready viewing of the patient's face by the anesthesiologist. Of great advantage also, this embodiment of the invention can be used so that the patient's face can be viewed from either the left or right side, as desired by the anesthesiologist. Moreover, this more preferred head support means of the invention allows greater freedom to the anesthesiologist in locating the materials that will be used by him during the operation.

BRIEF DESCRIPTION OF THE DRAWINGS

Some of the features and advantages of the present invention have been described; others will become apparent from a reading of the detailed description which follows, taken in conjunction with the accompanying drawings in which.

DETAILED DESCRIPTION OF THE DRAWINGS AND THE PREFERRED EMBODIMENTS

While the present invention will be described hereinafter with particular reference to the accompanying drawings, it is to be understood at the outset that it is contemplated that the present invention may be varied in specific detail from that illustrated and described herein while still achieving the desirable characteristics and features of the invention. Accordingly, the description which follows is intended to be understood as a broad enabling disclosure directed to persons skilled in the applicable arts, and is not to be understood as being restrictive.

Figure 1:
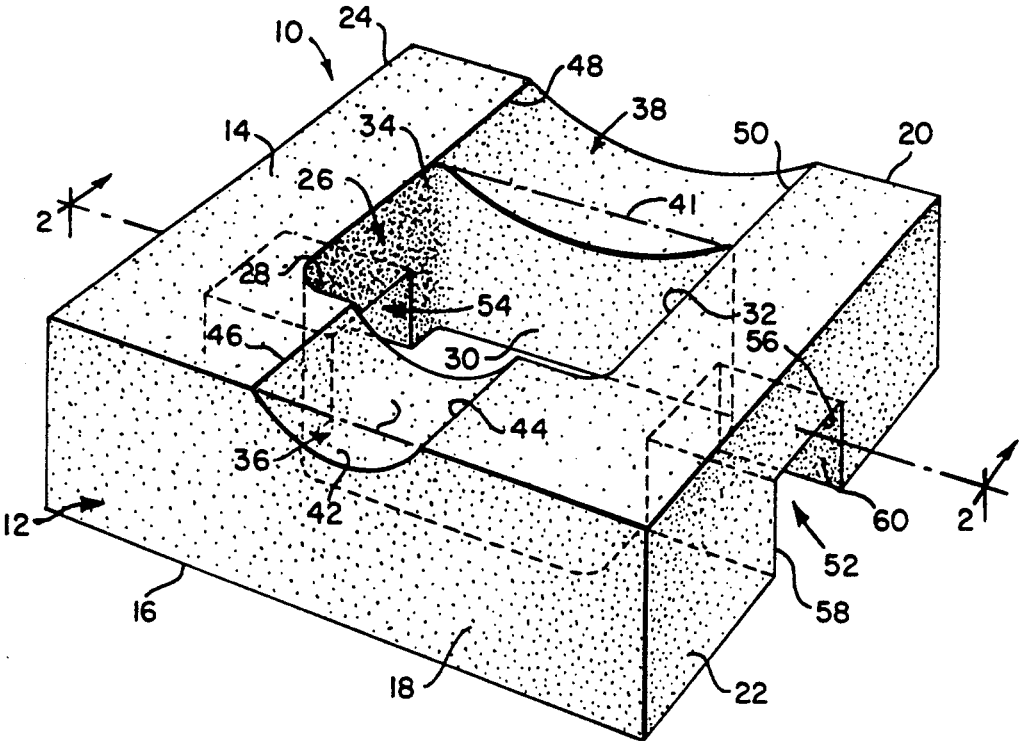
FIG. 1 is a view in perspective of one embodiment of a head support means according to the invention.
Figure 2:
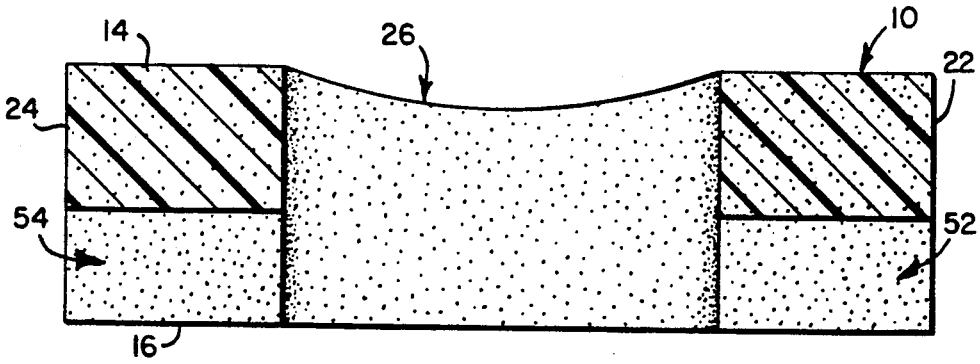
FIG. 2 is a view in cross-section of the head support means shown in FIG. 1 taken at secant lines 2—2.

Turning now to the drawings, there is disclosed in FIG. 1 thereof a support means 10 in accordance with the invention for supporting a person's head while lying in the prone position. The head support means 10 comprises a cubic, rectangular-shaped body member 12. The body member 12 is defined by top and bottom, horizontally disposed, spaced-apart, planar surfaces 14, 16 parallel to one another, parallel, spaced-apart, planar, vertically disposed front and back end walls 18, 20, and parallel, spaced-apart, planar, vertically disposed first and second side walls 22, 24. The end walls 18, 20 are vertically disposed and each terminates at the ends of vertically disposed side walls 22, 24.

There is provided in the top surface 14 of the body member 12 an opening 26 which extends inwardly from the top surface and terminates at the bottom surface 16. This opening, as seen from FIG. 1, is of a rectangular shape, defined by vertically upright, planar, front and back walls 28, 30, spaced-apart from one another, and parallel, side walls 32, 34. These latter side walls are parallel to one another, planar and spaced-apart a predetermined distance, as hereinafter further disclosed.

As shown in FIG. 1, there are provided in the top surface 14 of body member 12, arcuate-shaped indentations or cavities 36, 38, the purpose for which will be disclosed more fully hereinafter. The arcuate-shaped cavity 36 in the practice of the invention is defined by a round cylinder generated in usual fashion by a circle having an imaginary chord as shown by dotted line 40. This dotted line 40 lies in the same plane as that defined by top surface 14. Thus, there is provided an arcuate-shaped indentation 36 having a predetermined depth, such being represented generally by the dotted line 42. The line 42 lies on a radius of the circle generated and measures about 1¼ inches.

The arcuate-shaped cavity 36 is defined at its front and back ends by the front end wall 18 of body member 12 and front wall 28 of opening 26, respectfully. Cavity 36 is located midway between the sidewalls 22, 24 of body member 12 and is defined further by ends 44, 46, parallel to one another and to the top ends of vertically upright side walls 22, 24. These ends of cavity 36 are perpendicularly disposed with respect to the top ends of the front and back end walls 18, 20. In the practice of the invention, an imaginary chord 40 measuring 3¼ inches has been found quite satisfactory.

The arcuate-shaped cavity 38 is defined by spaced-apart ends 48, 50 parallel to the ends 44, 46, respectively, of arcuate-shaped cavity 36. Its front and back ends are defined by the back end 30 of the opening 26 and the back end 20 of the body member 12.

As shown by FIG. 1, the cavity 38 is located so as to be centrally disposed between the side walls 22, 24 of body member 12. Thus, an imaginary plane located mid-way between the planes defined by side walls 22, 24, and parallel thereto, divides the arcuate-shaped cavities 36, 38 in half.

The arcuate-shaped cavity 38 is of a predetermined size somewhat larger than cavity 36. Thus, its depth from the top surface 14 at the middle dividing plane will be somewhat less than that of cavity 36. A depth of about 1 inch for the forehead rest has been found quite satisfactory in the practice of the invention. An imaginary chord 41 connecting the ends 48, 50 of the arc defined by the arcuate-shaped surface measures about 6¼ inches. Thus, there is provided a cavity 38 having a width of about 6¼ inches and a depth of about 1 inches. It will be appreciated, however, that such dimensions may vary somewhat depending primarily upon whether the head of an adult, child, or infant is to be supported, nevertheless, the dimensions of the chin and forehead rests of the head support means 10 disclosed earlier will, in general, be found quite satisfactory for supporting the head of an adult. As will be further disclosed later on the chin and forehead cavities 36, 38 need not necessarily be of different sizes. They can be, and such is most preferred in an operating room usage, symmetrical. The advantages of such a configured head support means will be more readily appreciated later on.

In the side walls 22, 24 of body member 12 there are provided elongated openings 52, 54, respectively, which extend inwardly from the respective side walls and terminate at the side walls 32, 34 of the opening 26. The purpose for such openings will be made clear hereinafter. The openings 52, 54 of the head support means 10 shown in FIG. 1 are located in direct opposition to one another. The openings are each open at their bottoms at bottom planar surface 16 of the body member. The openings of support means 10 are each located midway between the front and back end walls 18, 20 of body member 12. Thus, an imaginary plane, parallel to the front and back end walls 18, 20 divide each of the openings 52, 54 in half. The openings 52, 54 need not, however, be in opposition to one another. One opening can be, if desired, closer to the front end wall 18 than the other. While one opening is closer to end wall 18, the other can be located closer to the back end wall 20, rather than being located midway between the end walls, if desired.

The openings 52, 54, as shown in FIG. 1, are of equal size and shape. Accordingly, only one such opening will be more specifically disclosed. The opening 52 is of rectangular shape in cross-section and is defined by top planar surface 56, and planar side walls 58, 60, parallel to one another. The top planar surfaces of the openings 52, 54 both lie in the same horizontal plane, parallel to bottom surface 16. The openings 52, 54 can be other than rectangular shape, if desired. The particular shape of the openings 52, 54 do not affect the functioning of the head support means 10. Neither does the dimensions of these openings. Nevertheless, an opening 52 having a width of about 2¾ inches and a height of about 1½ inches will be found, in general, satisfactory. These openings should be, in general, of such a height and width to accommodate the needs of an anesthetist, if the head support means 10 is used in surgical procedures. The dimensions will, however, depend to some extent upon the intended usage, the overall dimensions of the head support means, and the foam density, as will be readily appreciated by those skilled in the art. The openings 52, 54 should not be of such a size as to lessen the desired support for a person's head. Where the head support means 10 is used other than for surgery on a person in the prone position, the support means may not need be provided with such openings 52, 54 at all.

Figure 3:
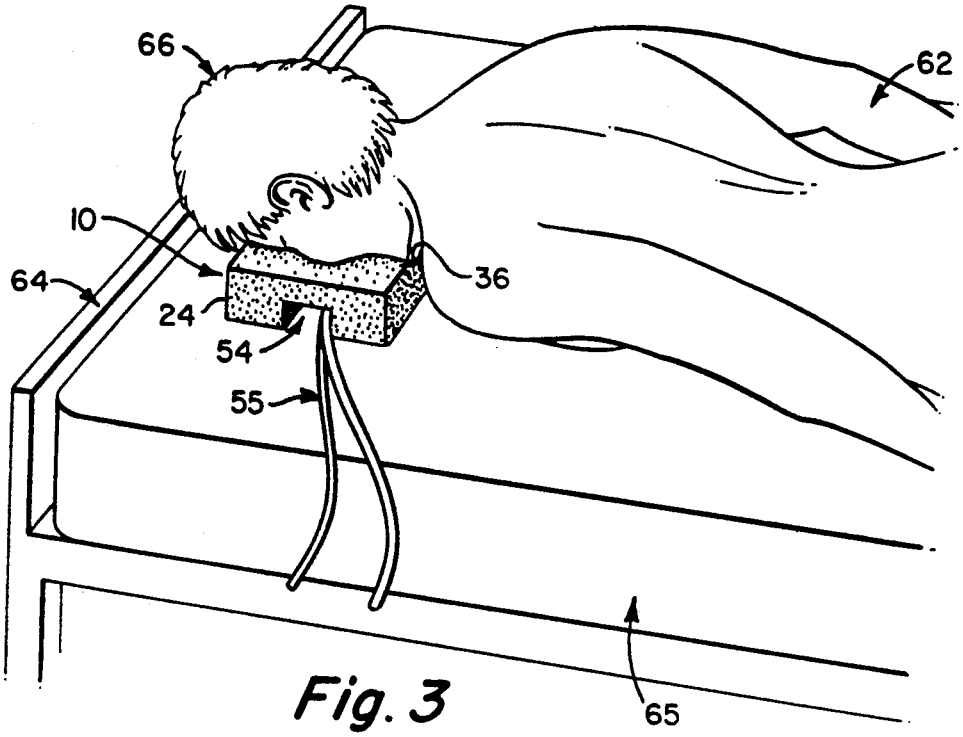
FIG. 3 is a perspective, schematic view showing use of the head support means shown in FIG. 1 for supporting the head of a patient lying in the prone position during an operation.

Referring now to FIG. 3 there is shown therein a patient 62 lying in the prone position on a conventional operating room bed 64 in preparation for surgery. A head support means 10 according to one embodiment of the invention is located on the horizontally disposed planar top surface of the mattress or support means 65. Thus, the support means 10 located centrally between the edges of the mattress and its top surface 16 lies in a horizontally disposed plane parallel to the floor of the operating room. The patient's face and eyes are located in the opening 26 in the support means 10. The patient's head 66 is provided in vertical disposition and is supported by the head support means 10 only by the patient's forehead resting in arcuate-shaped cavity 38 and the chin resting in arcuate-shaped cavity 36. It will be appreciated that, in accordance with the invention, the cheekbone area of the patient is free of any contact with the head rest or support means 10. Thus, no pressure point exists whereby soreness of the cheekbones may develop during surgery. Moreover, the side walls 32, 34 of the head support means opening 26 being spaced-apart from the patient's cheeks allows unobstructed free flow of air. Quite advantageously, the arcuate-shaped cavity, or forehead rest, 38 provides a relatively broad base member for supporting a patient's forehead. And the same is true relative to the arcuate-shaped cavity 36 upon which the patient's chin rests. Thus, the downward forces of the patient's head are caused to be distributed over a relatively wide area, resulting in less pressure against the head than where the head is supported by a somewhat smaller area, e.g., just at the cheek bone area.

In use, it will be seen by reference to FIG. 3, the patient's head 66 is caused to be centered by the arcuate-shaped indentations 36, 38 provided in body member 12. Moreover, the head support means 10 will provide not only more uniform support to the patient's head, but maintains such in an upright position, as desired. The dimensions of the arcuate-shaped supports 36, 38, as earlier disclosed, will allow the head to be rotated slightly by the anesthetist, as desired.

The opening 26 of head support means 10 is of such a width and length that it allows not only a free flow of air around the patient's face and cheek areas, as earlier mentioned, but also importantly ensures there are no pressure points against the patient's cheeks and, particularly against the patient's eyes. Thus, in combination with the openings 52, 54, the remaining open area in opening 26 more than provides sufficient air flow for the needs of the patient. The openings 52, 54 can further be used, if desired, by the anesthetist if the patient is receiving general endotracheal anaesthesia. And, an endotracheal air tube is represented generally by reference numeral 55.

As shown in FIG. 1 of the drawings, the head support means 10 is of a rectangular shape; however, the body member 12 need not necessarily be of this shape. The head support means 10 can be square, if desired, or even of circular shape. Nevertheless, a major consideration is that the head support body member 12 be provided with means for supporting a patient's head at the forehead and chin only, as disclosed herein. Also, of critical importance, the vertically disposed opening 26 provided centrally in the body member 12 need be of such a dimension as to allow free unobstructed air flow around the patient'& face when the patient's face is located in the opening. No pressure points, moreover, should be created on the patient's eyes or cheek bones.

The body member 12 can be provided of various materials, e.g., various plastic foams, whether of open or closed cells. The body member can be of a foam rubber, natural or synthetic, as desired. Suitable foams include rubber latex, polyurethane, polyethylene and vinyl foams. Whatever the material used, it should provide a soft, nonabrasive cushion for the patient's forehead and chin. It should, of course, be of a flexible foam but not be so compressed when a patient's head in the prone position is being supported as not to maintain that patient's spine in a suitable linear anatomic position.

In the practice of the invention, a body member 12 of a closed cell, medium density, polyurethane foam, has performed quite satisfactorily in a number of operations involving adult patients of varying weights estimated at, on the average, from about 150 lbs. to about 200 lbs. By medium density is meant polyurethane foam having a density of about 1.8 lbs./ft$^3$. Such a foam is desirably of a medical grade and is commercially available from E.R. Carpenter Company, Inc. of Richmond, Virginia. Nevertheless, it will be readily appreciated that for persons of a lesser or greater weight, a somewhat less or more dense foam may be better suited. Polyurethane foam is available from the above-disclosed company having a density of from about 1-3 lbs./ft.$^3$. The foam density deemed most optimum for use as body member 12 for persons of different weight ranges, or whether male, female, adult or child, can readily be determined by those skilled in the art.

The dimensions of a head support means according to the invention will depend to some extent upon the end user, i.e., whether the patient is an adult or child. Consideration also need be given to the density of the foam, in selecting the most optimum dimensions, in particular the height of body member 12. It will be readily appreciated that a lesser dense polyurethane foam will be compressed to a greater extent than a more dense foam, by the same patient. Thus, the extent of compression of any particular foam need also be taken into consideration. A foam body member that is compressed to such an extent, depending somewhat upon the height of such a body member, as not to provide the patient's spine in a suitable linear anatomic position, would not be satisfactory. Such a position can be determined readily by visual observation by an orthopedist. The head support means of the invention must not only provide good support for the patient's head but do so in a manner which would not put undue strain on the discs, ligaments, muscles and nerves in the neck.

A body member 12 according to the invention of medium density foam as above disclosed having a width of about 12¼", i.e., the distance between side walls 22, 24 and a length of about 10¼", i.e., the distance between front and back end walls 18, 20, has been found quite satisfactory in use in various surgical procedures, as earlier disclosed. Such a foam body member is provided with a centrally disposed opening extending in vertical upright manner from top surface 14 to bottom surface 16 having a width of about 7¼" and a length of about 3¾". The corners of this opening, and the corners of the body member 12, can be rounded, if desired e.g. provided with a ¾" radius. The height most preferred for body member 12 is from about 4½" to about 511. A foam body member of such dimension and medium density will be found quite satisfactory, and have suitable flexibility and compressibility, for the intended purpose.

The dimensions of the rectangular-shaped undercuts or openings 52, 54 in the body member 12 used in the practice of the invention measure about 1½" high by about 2¾" wide, i.e., along the length of the side wall.

Figure 4:
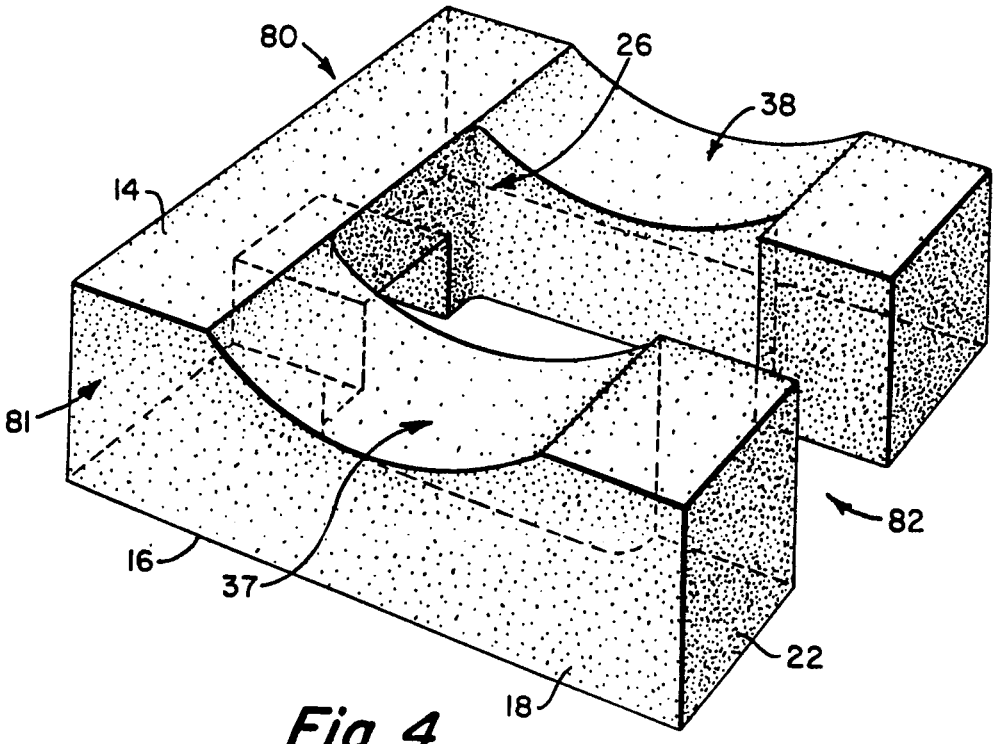
FIG. 4 is a perspective view of a further, more preferred embodiment of the invention in which an opening is provided allowing for greater access to the patient by the anesthesiologist and more freedom of placement under the patient's head.

Turning now to FIG. 4 of the drawings, there is shown another embodiment of the invention referred to generally by reference numeral 80. In the case of the head support means 80 shown in FIG. 4, however, it will be appreciated that the height of the opening 82 is the same as that of the body member 81.

The dimensions of the arcuate-shaped chin and forehead rests 37, 38 will preferably be the same. Such a feature will allow some greater flexibility in use of a head support means according to the invention. The two rests in this preferred embodiment have a width desirably about 6¼" with a medium density foam body member. The depth of such a cavity, as earlier disclosed, is about 1" from top surface 14 when the flexible body member is not compressed.

A head support means according to the invention can, most generally, be used alone and will provide good support for a patient's head, while the patient is lying in the prone position, with minimum risk of injury to the patient's neck. Nevertheless, in some cases, it may be desirable to elevate the patient's chest and abdomen so that with the patient's head resting on the support means, the cervical and thoracic spine will be provided in somewhat better linear alignment. This can readily be accomplished by use of a rectangular-shaped block of foam having the dimensions and density of that of the head support means body member disclosed herein. Other means, however, can be used for this purpose, e.g., a regular bed pillow or rolled sheets or towels, as now commonly used. Whether such elevation of the patient's chest for the particular surgical procedures is desirable can be readily determined by the orthopedist, at the time of preparation for the operation. This will be determined visually by the orthopedist. This further support will depend somewhat upon the particular patient involved, and the patient's weight and size, as well as the surgical procedure being performed. Thus, less discomfort to the patient may be caused, as a result of the increased extension of the spine between the cervical and thoracic regions, even though such extension would doubtfully result in any injury.

The manufacture of a head support means according to the invention can be accomplished by various conventional means. Thus, the support means can be provided by conventional injection molding techniques for polyurethane foams. With such a manufacturing process, the support means body member, along with the various openings disclosed, and the chin and forehead rests to be provided therein, can be provided in one step. Nevertheless, if desired, a block of foam can be formed first, followed by cutting out of the various openings and the chin and forehead rests by usual techniques.

Although the head support means 10 will be found quite satisfactory in many surgical operations wherein the patient must lie in the prone position, the further embodiment of this invention shown in FIG. 4 will be found somewhat more preferred when a patient is given general endotracheal anesthesia.

Figure 5:
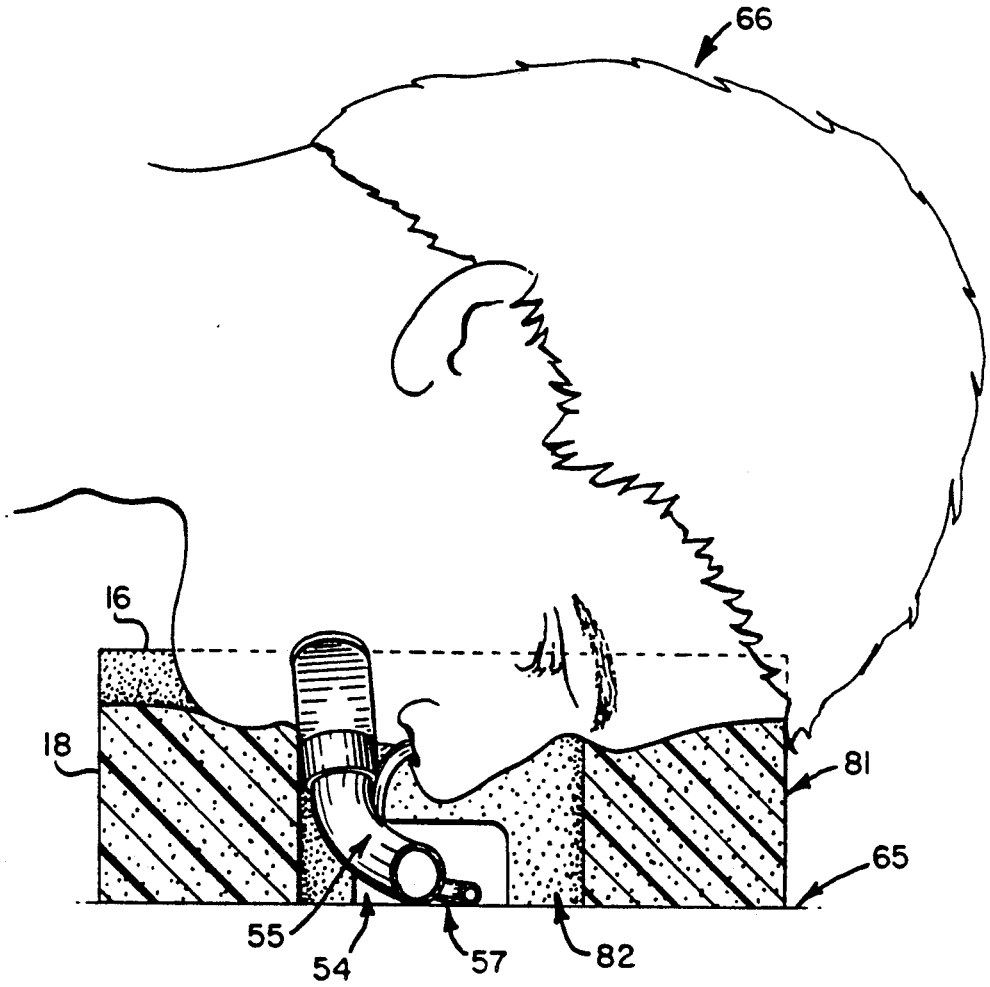
FIG. 5 is a schematic view showing a patient's head in the prone position supported by the head rest means of the invention shown in FIG. 4 and showing the patient's head supported at the forehead and chin and an endotrachael air tube and a nasogastric tube being connected to the patient.

Each of the head support means comprises a flexible body member and is provided with arcuate-shaped cavities for support of the patient's head at the forehead and chin only. The critical difference in the two support means, however, resides in the opening 82 provided in body member 81 and the chin and head rests being of like dimension and shape. As shown in FIG. 4, opening 82 extends not only inwardly from side wall 22 to the centrally disposed opening 26 but from bottom surface 16 to top surface 14 of the body member 81. Thus, there is provided an unobstructed view of the patient's face by the anesthetist, as is shown in FIG. 5. As shown in that FIGURE of the drawing, not only can the patient's eyes and mouth and nose area be seen by the anesthetist during the surgery, but there is ample room provided in this head support means of the invention for the anesthetist to make any adjustment desired, or needed, in the endotracheal air or other tubes as the surgery proceeds.

The construction of the head support means 80 is of great advantage and convenience to the anesthetist over those head support means known of in the prior art, when such is used in surgery on a patient lying in the prone position and the patient receives general endotracheal anesthesia. As will be better appreciated in the disclosure which follows, the head support means 80 offers advantages over the head support means 10. This results from the fact that anesthesia is begun while the patient is in a supine position (lying on the back). Thus, an endotracheal air tube 55 may be placed through the mouth as well as additional tubes including sometimes a nasogastric tube through the nose as shown generally by reference numeral 57 (FIG. 5). In some cases temperature and other monitoring probes may also be used. Afterwards, the patient is then turned to the prone position for the specific operation, usually some kind of back surgery, e.g., laminectomy. In order to use the prior art devices known, including the head support means 10 earlier disclosed, the various tube and probes will need be first disconnected from the patient. The tubes and probes are then placed through the openings provided in the head support means, e.g., opening 54 (FIG. 3) and reattached. As will be well appreciated, this procedure has been found to be quite inconvenient, at least by some anesthesiologists.

With the head support means 80 of this invention, however, there is no need to disconnect any of the tubes or probes used by the anesthesiologists. Instead, anesthesia is begun and the patient, quite advantageously, can be turned to the prone position without need for disconnecting any of the tubes or probes. The vertically disposed elongated opening 82 and the flexibility of the body member 81 allows the support means 80 to be easily placed under the patient's head and around all the tubes and probes then in place. Importantly, as none of the tubes and monitors need be disconnected with use of a head support means 80 according to this aspect of the invention, critical monitoring of the patient's vital signs will not need be interrupted.

The head support means of this invention critically allows the neck to be supported in a linear, anatomic manner and, moreover, some gentle side-to-side, rocking, motion of the head by the anesthetist for better facial observation during the surgical procedure. Furthermore, and of advantage to the anesthetist, is the fact that head support means 80 is reversible. Thus, it can be flipped over so that opening 82 is to the left or right, as desired, to accommodate the various tubes and monitors being used. This is of extreme advantage where the location of various equipment in the operating room is not readily movable, if at all. Further, it will be appreciated, that the flexibility of the head support means 80 allows the opening 82 to be made larger or smaller as desired. The providing of the chin and head rest of the same shape and dimensions, as disclosed herein, importantly allows somewhat greater advantage also to the anesthetist in some rotation of the patient's head, if desired. This will enable the anesthetist to better view the facial features of the patient during the operation. Nevertheless, the curvature of such chin and head rests importantly inhibit rotation of the patient's head in an acute angle.

Although not shown in the drawings, a disposable cover could be provided for a head support means of this invention. The providing of such a cover is well within the skill of those in the art. With such a cover, the head support means can be kept clean for repeated usage.

The most common surgical procedure wherein a head support means according to the invention, especially that disclosed in FIG. 4, may be utilized is back surgery, such as a laminectomy, discectomy, foraminotomy, or decompression, whether it be in the cervical, thoracic lumbar, or sacral portions of the back. Such a head support means allows the anesthetist, because of the symmetrical size of the chin and forehead rests and the extended opening on the one side, to position the support means to allow right or left positioning of the tubes exiting the nose and mouth. Moreover, importantly, the use of such a support means makes it unnecessary to disconnect any of the tubes in turning the patient from the supine to the prone position.

Nevertheless, it will be appreciated that a head support means of the invention can be used in various situations. Other and various uses can be made of the head support means disclosed herein. For example, the head support means can be used in the x-ray departments of hospitals as a positioner of the head; in recovery rooms of hospitals following surgery for the control and immobilization of the head; and, in transporting a patient throughout the hospital, e.g., from the recovery room to the patient's room, particularly when the patient is still under anesthesia and it is difficult to control his head from movement and it might otherwise be injured.

As will be readily appreciated, use of the head support means of the invention is not limited to a hospital. The support means as disclosed in FIG. 1, in particular, will find use wherever a person desires to lie in the prone position and have unobstructed breathing without having to turn his neck in an acute position and risking possible cervical injury. For example, the head support means of FIG. 1 can be used in face down exercises, if desired. Also, such a head support means can be used by one at the beach for sun bathing.

It will be understood that changes may be made in the head support means disclosed herein without departing from the scope of the invention. Accordingly, it is intended that all matter contained in the above description or shown in the accompanying drawings be interpreted as illustrative rather than in a limiting sense. Further, it should be also understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. Means for supporting a person's head by supporting the person's forehead and chin while such person is lying in a face-down position, said means comprising a cubic-shaped body member of resiliently compressible material defined by parallel, spaced-apart, planar top and bottom surfaces, parallel, spaced-apart planar front and back end walls, and parallel, spaced-apart, side walls, an opening in said body member extending inwardly from the top surface and terminating in a plane defined by the planar bottom surface, a first arcuate-shaped cavity of predetermined size being provided in the top surface centrally disposed and extending between the parallel side walls adjacent the back end wall for supporting the person's forehead, a second arcuate-shaped cavity being provided in the top surface centrally disposed and extending between the parallel side walls adjacent the front end wall for supporting the person's chin, an opening being provided in each of the side walls, and extending therethrough, one of said side wall openings extending from the top surface of the body member to the bottom surface of the body member whereby an opening of sufficient size is provided so that the person's face whose head is being supported is ready visible.

2. Means according to claim 1 wherein the arcuate-shaped cavities are of like dimension and shape.

3. Means according to claim 1 wherein the openings in the side walls are in direct opposition to one another.

4. Means according to claim 1 wherein the resiliently compressible material provides sufficient support to said person's head to maintain that person's spine in substantially a linear anatomic position.

5. Means according to claim 1 wherein the resiliently compressible material has a density of from about 1–3 lbs./ft.$^3$.

6. Means according to claim 5 wherein the compressible material is polyurethane foam.

7. Means according to claim 6 wherein the polyurethane foam is characterized as a closed cell, medium density foam having a density of about 1.8 lbs./ft.$^3$.

8. Means suitable for supporting a person's head during a surgical procedure while such a person is lying in the prone position comprising a body member of a resiliently compressible material and defined by parallel, spaced-apart top and bottom surfaces, and an outer peripheral surface, a first arcuate-shaped cavity of predetermined size being provided in the top surface of the body member for support the person's forehead, a second arcuate-shaped cavity of predetermined size being provided in the top surface for supporting the person's chin and in spaced-apart direct opposition to said first arcuate-shaped cavity, an opening being provided in said body member extending inwardly from the top surface and terminating in the bottom surface, said opening being located between the arcuate-shaped cavities and defining an inner peripheral surface in the body member, the opening being of a dimension whereby only the person's chin and forehead are supported by the body member and the person's cheeks and eyes are not in contact with the body member, and a second opening is provided in the body member which is defined by the top and bottom surfaces and the inner and outer peripheral surfaces whereby the person's face whose head is being supported is readily visible during the surgical procedure.

9. Means according to claim 8 wherein the outer peripheral surface of the body member is defined by parallel, spaced-apart, planar, front and back end walls and parallel, spaced-apart, side walls intersecting therewith at ninety degree angles, and the arcuate-shaped cavities are each centrally disposed between the side walls and extend between the front and back end walls.

10. Means according to claim 9 wherein the first arcuate-shaped cavity is located adjacent the back end wall, and the second arcuate-shaped cavity is located adjacent the front end wall, the second arcuate-shaped cavity being of a lesser predetermined depth and length across than the first arcuate-shaped cavity.

11. Means according to claim 10 wherein the resiliently compressible material provides sufficient support to said person's head to maintain that person's spine in substantially a linear anatomic position.

12. Means according to claim 11 wherein the compressible material is polyurethane foam.

13. Means according to claim 12 wherein the polyurethane foam is characterized as having a density of about 1.8 lbs./ft$^3$.

14. Means according to claim 9 wherein the top and bottom surfaces are of rectangular shape and the distance between the side walls measures about 12¼" across, the distance between the front and back end walls is about 10¼. "

15. Means according to claim 14 wherein the height of the body member is from about 4½" to about 5", the arcuate-shaped chin rest has a length across of about 3¾" as measured on the top surface and a depth of about 1½" measured from the center of the cavity at its midpoint, the arcuate-shaped forehead rest has a length across of about 6¼" as measured on said top surface of the body member and a depth of about 1¼" from the center of the cavity at its midpoint on the top surface.

16. Means according to claim 15 wherein the resilient compressible material is of sufficient density to support the person's head to maintain that person's spine in substantially a linear anatomic position.

* * * * *